US005481642A

United States Patent [19]

Shoham

[11] Patent Number: 5,481,642

[45] Date of Patent: Jan. 2, 1996

[54] CONSTRAINED-STOCHASTIC-EXCITATION CODING

[75] Inventor: Yair Shoham, Berkeley Heights, N.J.

[73] Assignee: AT&T Corp., Murray Hill, N.J.

[21] Appl. No.: 287,636

[22] Filed: Aug. 8, 1994

Related U.S. Application Data

[63] Continuation of Ser. No. 402,006, Sep. 1, 1989, abandoned.

[51] Int. Cl.[6] ..... G10L 9/00

[52] U.S. Cl. ..... 395/2.28; 395/2.73

[58] Field of Search ..... 381/29–43; 395/2.28–2.32, 395/2.73

[56] References Cited

U.S. PATENT DOCUMENTS

| | | | |
|---|---|---|---|
| 4,797,926 | 1/1989 | Bronson et al. | 381/36 |
| 4,827,517 | 3/1989 | Atal et al. | 381/41 |
| 4,868,867 | 9/1989 | Davidson et al. | 381/35 |
| 4,899,385 | 2/1990 | Ketchum et al. | 381/36 |

OTHER PUBLICATIONS

"Stochastic Coding of Speech Signals at Very Low Bit Rates", by B. S. Atal and M. R. Schroeder, *Proceedings IEEE Int. Conf. Comm.*, pp. 1610–1613, May 1984.

"Code-Excited Linear Predictive (CELP): High Quality Speech at Very Low Bit Rates", by M. R. Schroeder and B. S. Atal, *Proc. IEEE Int. Conf. ASSP*, pp. 937–940, 1985.

"A Class of Analysis-by-Synthesis Predictive Coders for High-Quality Speech Coding at Rate Between 4.8 and 16 Kb/s", by P. Kroon and E. F. Deprettere, IEEE J. on Sel. Area in Comm. SAC-6(2), pp. 353–363, Feb. 1988.

"Quantization Procedures for 4.8 Kb/s CELP Coders", by P. Kroon and B. S. Atal, IEEE Int. Conf. ASSP, pp. 1649–1652, 1987.

"Predictive Coding of Speech at Low Bit Rates", by B. S. Atal, IEEE Transactions on Communications, vol. COM-30, pp. 600–614, Apr. 1982.

"Predictive Coding of Speech Signals and Subjective Error Criteria", by B. S. Atal et al., *IEEE Trans. ASSP*, vol. ASSP-2, No. 3, pp. 247–254, Jun. 1979.

Applications of Digital Signal Processing, A. V. Oppenheimer, Ed., Prentice-Hall, Englewood Cliffs, New Jersey, pp. 147–156, 1978.

"Improved Speech Quality and Efficient Vector Quantization in CELP", by W. B. Kleijn et al., *Proc. IEEE Conf. ASSP*, pp. 155–159, 1988.

"The Self-Excited Vocoder—An Alternate Approach to Toll Quality at 4800 bps", by R. C. Rose et al., Proc. IEEE ICASSP-86, pp. 453–456, 1986.

*Primary Examiner*—Allen R. MacDonald
*Assistant Examiner*—Michelle Doerrler
*Attorney, Agent, or Firm*—Katharyn E. Olson

[57] ABSTRACT

In Code Excited Linear Predictive (CELP) coding, stochastic (noise-like) excitation is used in exciting a cascade of long-term and short-term all-pole linear synthesis filters. This approach is based on the observation that the ideal excitation, obtained by inverse-filtering the speech signal, can be modeled for simplicity as Gaussian white noise. Although such stochastic excitation resembles the ideal excitation in its global statistical properties, it contains a noisy component that is irrelevant to the synthesis process. This component introduces some roughness and noisiness in the synthesized speech. The present invention reduces this effect by adaptively controlling the level of the stochastic excitation. The proposed control mechanism links the stochastic excitation to the long-term predictor in such a way that the excitation level is inversely related to the efficiency of the predictor. As a result, during voiced sounds, the excitation level is considerably attenuated and the synthesis is mainly accomplished by exciting the short-term filter with the periodic output of the long-term filter. This reduces the noisiness, enhances the pitch structure of the synthesized speech and its perceptual quality.

8 Claims, 3 Drawing Sheets

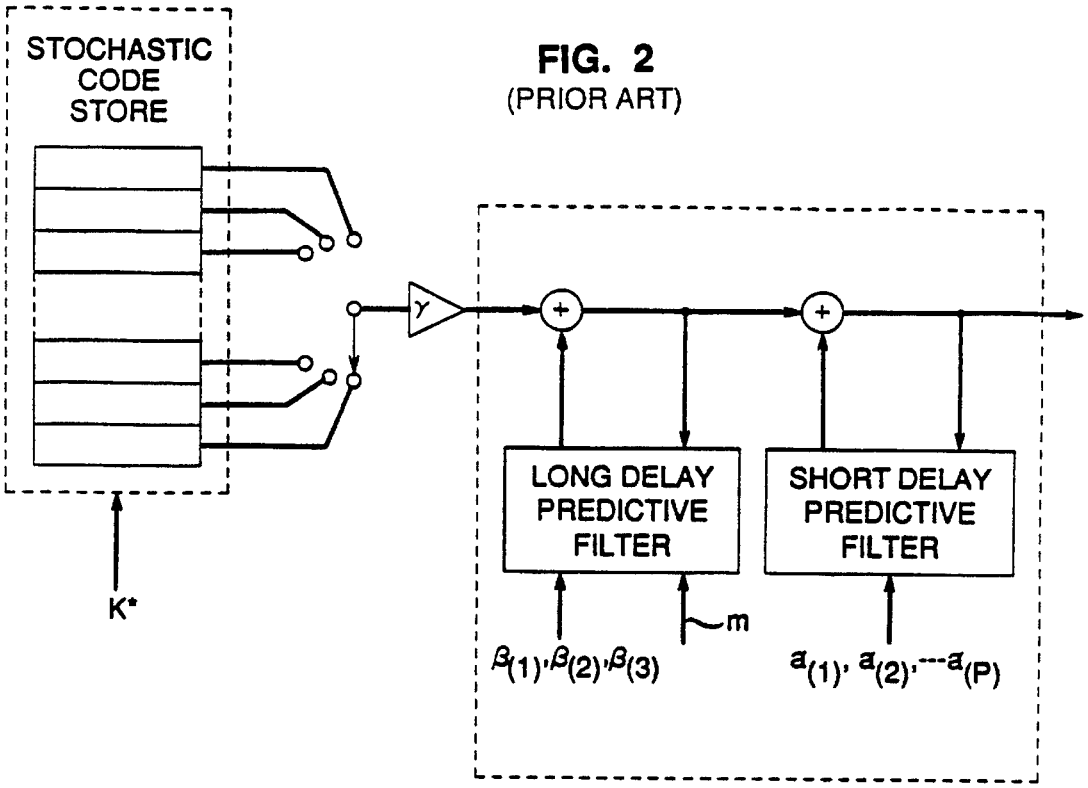
FIG. 2
(PRIOR ART)
FIG. 3
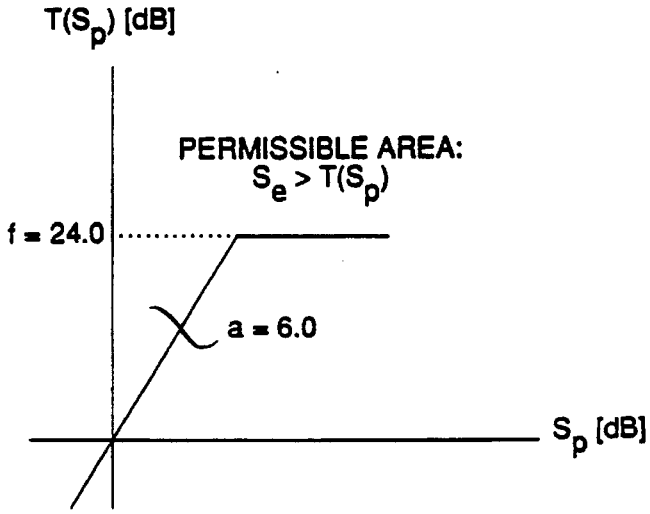

CONSTRAINED-STOCHASTIC-EXCITATION CODING

This application is a continuation of application Ser. No. 07/402,006, filed on Sep. 1, 1989 now abandoned.

FIELD OF THE INVENTION

This invention relates to coding of information and, more particularly to efficient coding of information, e.g., speech, which can be represented as having a stochastic component under some circumstances.

BACKGROUND OF THE INVENTION

In the last few years, Code-Excited Predictive (CELP) coding has emerged as a prominent technique for digital speech communication at low rates, e.g., rates of 8 Kb/s and it is now considered a leading candidate for coding in digital mobile telephony and secure speech communication. See, for example, B. S. Atal, M. R. Schroeder, "Stochastic Coding of Speech Signals at Very Low Bit Rates", *Proceedings IEEE Int. Conf. Comm.*, May 1984, page 48.1; M. R. Schroeder, B. S. Atal, "Code-Excited Linear Predictive (CELP): High Quality Speech at Very Low Bit Rates", *Proc. IEEE Int. Conf. ASSP.,* 1985, pp. 9370940; P. Kroon, E. F. Deprettere, "A Class of Analysis-by-Synthesis Predictive Coders for High-Quality Speech Coding at Rate Between 4.8 and 16 Kb/s", *IEEE J. on Sel. Area in Comm. SAC*-6(2), February 1988, pp. 353–363; P. Kroon, B. S. Atal, "Quantization Procedures for 4.8 Kb/s CELP Coders", *Proc. IEEE Int. Conf. ASSP*, 1987, pp. 1650–1654; and U.S. Pat. No. 4,827,517 issued Mar. 17, 1989 to B. Atal et al and assigned to the assignee of the present invention.

While the CELP coder is able to provide fairly good-quality speech at 8 Kb/s, its performance at 4.8 Kb/s is yet unsatisfactory for some applications. A feature of the CELP coding concept, namely, the stochastic excitation of a linear filter, also constitutes a potential weakness of this method. That is, the stochastic excitation, in general, contains a noisy component which does not contribute to the speech synthesis process and cannot be completely removed by the filter. It is desirable, therefore, to maintain the low bit rate feature of CELP coding while improving the perceived quality of speech reproduced when the coded speech is decoded.

SUMMARY OF THE INVENTION

In accordance with one aspect of the present invention, it proves advantageous in a speech coding system to adaptively constrain the level of stochastic excitation provided as input to a linear predictives filter (LPF) system by linking such level to a performance index of the long-term (pitch-loop) sub-system. More particularly, a gain factor for the level of excitation signal is adaptively adjusted as a function of the error achieved by the LPF coder with no contribution by the stochastic excitation. Thus, if the pitch-loop and filter parameters would be sufficient to allow a good approximation to the input signal, then the actual level of stochastic excitation specified is low. When the pitch loop and LPF parameters are not sufficient to reduce the error to an acceptable level, the specified level of the stochastic excitation is higher. This operation reduces the noisy effects of the stochastic excitation, enhances the synthesized speech periodicity and hence, the perceptual quality of the coder.

In its more general aspects, the present invention has applicability to other systems and processes which can be represented as a combination of (i) a first set of parameters susceptible of explicit determination (at least approximately) by analysis and measurement, (ii) and a second set of parameters representative of a stochastic process which may have adverse effects (as well as favorable effects) on the overall system or process. The present invention then provides for the adaptive de-emphasis of the component of the combination reflecting the stochastic contribution, thereby to reduce the less favorable effects, even at the price of losing more favorable contributions when such de-emphasis improves the overall system as process performance.

BRIEF DESCRIPTION OF THE DRAWINGS

FIG. 2 shows a prior art CELP decoder,

FIG. 3 shows a threshold function advantageously used in one embodiment of the present invention.

DETAILED DESCRIPTION

Introduction and Prior Art Review

The coding system of the present invention, in illustrative embodiment, is based on the standard Codebook-Excited Linear Predictive (CELP) coder which employs the traditional excitation-filter model. A brief description of such prior art systems will first be presented. The available literature including the above-cited references may profitably be reviewed to gain a more complete understanding of these well-known systems.

Figure 1:
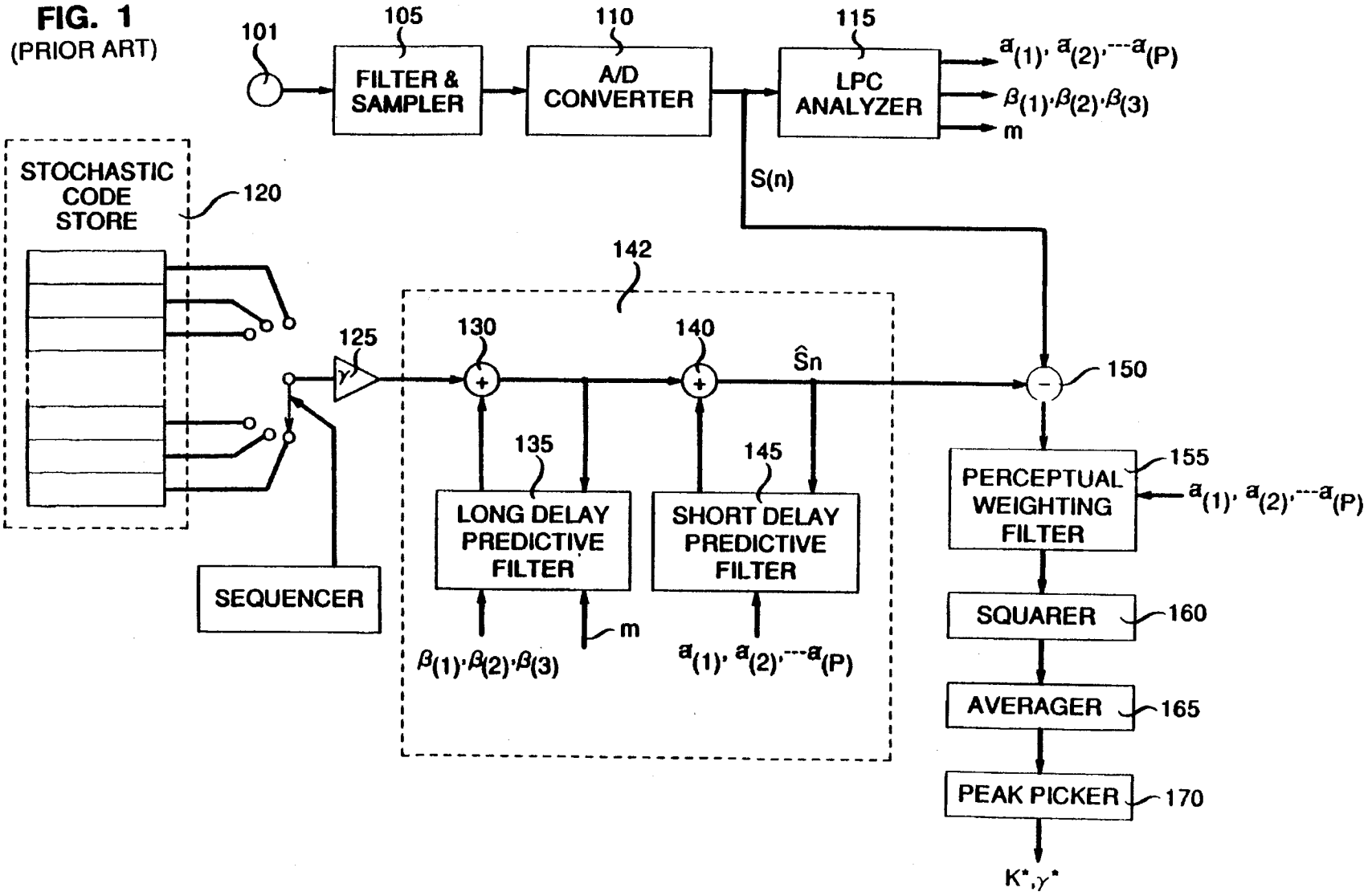
FIG. 1 (PRIOR ART)
FIG. 1 shows a prior art CELP coder.

Referring to FIG. 1, a speech pattern applied to microphone 101 is converted therein to a speech signal which is band pass filtered and sampled in filter and sampler 105 as is well known in the art. The resulting samples are converted into digital codes by analog-to-digital converter 110 to produce digitally coded speech signal s(n). Signal s(n) is processed in LPC and pitch predictive analyzer 115. This processing includes dividing the coded samples into successive speech frame intervals. Throughout this discussion, we assume that the time axis origin aligns with the beginning of the current frame and all the processing is done in the time window [n=0, . . . , N−1] (N being the frame size, i.e., the number of samples in a frame). The processing by analyzer 115 further includes producing a set of parameter signals corresponding to the signal s(n) in each successive frame. Parameter signals shown as a(1), a(2), . . . ,a(p) in FIG. 1 represent the short delay correlation or spectral related features of the interval speech pattern, and parameter signals β(1), β(2), β(3), and m represent long delay correlation or pitch related features of the speech pattern. In this type of coder, the speech signal frames or blocks are typically 5 msesc or 40 samples in duration. For such blocks, stochastic code store 120 may contain 1024 random white Gaussian codeword sequences, each sequence comprising a series of 40 random numbers. Each codeword is scaled in scaler 125, prior to filtering, by a factor γ that is constant for the 5 msec block. The speech adaptation is done in recursive filters 135 and 145.

Filter 135 uses a predictor with large memory (2 to 15 msec) to introduce voice periodicity and filter 145 uses a predictor with short memory (less than 2 msesc) to introduce the spectral envelope in the synthetic speech signal. Such filters are described in the article "Predictive Coding of Speech at Low Bit Rates" by B. S. Atal appearing in the *IEEE Transactions on Communications*, Vol. COM-30, pp. 600–614, April 1982. The error representing the difference between the original speech signal s(n) applied to differencer 150 and synthetic speech signal ŝ(n) applied from filter 145 is further processed by linear filter 155 to attenuate those frequency components where the error is perceptually less important and amplify those frequency components where the error is perceptually more important. The stochastic code sequence from store 120 which produces the minimum mean-squared subjective error signal E(k) and the corresponding optimum scale factor γ are selected by peak picker 170 only after processing of all 1024 code word sequences in store 120.

These parameters, as well as the LPC analyzer output, are then available for transmission to a decoder for ultimate reproduction. Such a prior art decoder is shown in FIG. 2. As can be seen, the excitation parameters K* and scale factor γ cause an excitation sequence to be applied to the LPC filter whose parameters have been supplied by the encoder on a frame-by-frame basis. The output of this filtering provides the desired reproduced speech.

To permit a better understanding of the context of the improvement gained by using the present invention, the above generalized CELP process will be analyzed in more detail. More particularly, s(n) is filtered by a pole-zero, noise-weighing linear filter to obtain X(z)=S(z) A(z)/A'(z), i.e., X(z) (x(n) in the time domain) is the target signal used in the coding process. A(z) is the standard LPC polynomial corresponding to the current frame, with coefficients $a_i$, i=0, . . ., M, ($a_0$=1.0). A'(z) is a modified polynomial, obtained from A(z) by shifting the zeroes towards the origin in the z-plane, that is, by using the coefficients $a'_i=a_i\gamma^i$ with $0<\gamma<1$. (typical value: γ=0.8). This pre-filtering operation reduces the quantization noise in the coded speech spectral valleys and enhances the perceptual performance of the coder. Such pre-filtering is described in B. S. Atal, et at, "Predictive Coding of Speech Signals and Subjective Error Criteria," *IEEE Trans. ASSP*, Vol. ASSP-2, No. 3, June 1979, pp. 247–254.

The LPC filter A(z) is assumed to be a quantized version of an all-pole filter obtained by the standard autocorrelation-method LPC analysis. The LPC analysis and quantization processes performed in LC Analyzer are independent of the other parts of the CELP algorithm. See the references cited above and *Applications of Digital Signal Processing*, A. V. Oppenheimer, Ed., Prentice-Hall, Englewood Cliffs, N.J., 1978, pp. 147–156.

The coder attempts to synthesize a signal y(n) which is as close to the target signal x(n) as possible, usually, in a mean square error (MSE) sense. The synthesis algorithm is based on the following simple equations $$\sum_{i=0}^{M} a'_i y(n-i) = r(n) \tag{1}$$

$$r(n) = \beta r'(n,P) + gc(n) \tag{2}$$

$$r'(n,P) = \begin{cases} r(n-P), & n < P \\ r'(n-P,P), & n \geqq P \end{cases} \tag{3}$$

β and P are the m-called pitch tap and pitch lag respectively. g is the excitation gain and c(n) is an excitation signal. The gain symbol g has been changed from the γ symbol used in the above description to reflect the adaptive qualifies given to it in accordance with the present invention. These qualities will be described in detail below. Each of the entities β, P, g, c(n) takes values from a predetermined finite table. In particular, the table for the excitation sequence c(n) (the excitation codebook) holds a set of N-dimensional codevectors.

The task of the coder is to find a good (if not the best) selection of entries from these tables so as to minimize the distance between the target and the synthesized signals. The sizes of the tables determine the number of bits available to the system for synthesizing the coded signal y(n).

Notice that Eq. (2) and (3) represent a 1st-order pitch-loop (with periodic extension) as described in W. B. Kleijn et al, "Improved Speech Quality and Efficient Vector Quantization in CELP," *Proc.IEEE Conf. ASSP*, 1988, pp. 155–159. A higher-order pitch loop could also be used, but spreading the limited number of bits for transmitting parameters of more than one pitch loop has not been found to yield higher performance. Use of a first order pitch loop does not significantly affect the application of the present invention; moreover, it permits reduced complexity in the present analysis and in operation and computation. Those skilled in the art will recognize that higher order pitch loops may be used in particular applications.

The actual output signal, denoted by z(n) (Z(z) in the z-domain), is obtained by using the inverse of the noise-weighting filter. This is accomplished simply by computing Z(z)=R(z) (1/A(z)) where R(z) is the z-domain counterpart of r(n). Note that, in general, minimizing the MSE distance between x(n) and y(n) does not imply the minimization of the MSE between the input s(n) and the output z(n). Nevertheless, the noise-weighing filtering has been found to significantly enhance the perceptual performance the CELP coder.

A key issue in CELP coding is the strategy of selecting a good set of parameters from the various codebooks. A global exhaustive search, although possible, in principle, can be prohibitively complex. Therefore, several sub-optimal procedures are used in practice. A common and sensible strategy is to separate the pitch parameters P and β from the excitation parameters g and c(n) and to select the two groups independently. This is a "natural" way of dealing with the problem since it separates the redundant (periodic) part of the system from the non-redundant (innovative) one. P and β are found first and then, for a fixed such selection, the best g and c(n) are found. The definition of the synthesis rule as in Eq. (1)–(3) allows us to do this separation in a rather simple way. The linearity of the system permits us to combine Eqs. (1) and (2) in the form $$y(n)=y_0(n)+\beta r'(n,P)*h(n)+g\ c(n)*h(n) \tag{4}$$

where $y_0(n)$ is the response to the filter initial state without any input and h(n) is the impulse response of 1/A'(z) in the range [0, . . . ,N−1)]. The notation * denotes the convolution operation. The best P and β are given by $$P^*,\hat{\beta} = \underset{P,\beta}{\operatorname{armin}} \| \quad x(n) - y_0(n) - \beta r'(n,P)*h(n) \| \tag{5}$$

where the search is done over all the entries in the tables for β and P. The notation ||·|| indicates the Euclidean norm of the corresponding time-sequence. The values for P are typically in the integer range [20, . . . ,147] (7 bits). The table for β typically contains 8 discrete values (3 bits) in the approximate range [0.4, . . ., 1.5].

In an even less complex approach, P and β are found independently of each other by first allowing β to obtain an optimal (unquantized) value and finding the best P and, then, quantizing the optimal β corresponding to the best P. In this case, the optimization problem (for the best P) is $$P^* = \underset{P}{\operatorname{armax}} \frac{\langle x(n) - y_0(n), r'(n,P)*h(n)\rangle^2}{\|r'(n,P)*h(n)\|^2} \tag{6}$$

where <.,.> denotes an inner-product of the arguments. The optimal β for the best pitch P* is given by $$\beta^* = \frac{\langle x(n) - y_0(n), r'(n,P^*)*h(n)\rangle}{\|r'(n,P^*)*h(n)\|^2} \tag{7}$$

This value is quantized into its nearest neighbor from the 3-bit codebook to obtain $\hat{\beta}$.

Once $\hat{\beta}$ and P* are found, the coder attempts to find a best match to the resulting error signal $d(n)=x(n)-y_0(n)-\hat{\beta}r'(n, P^*)*h(n)$ by finding $$\hat{g},\hat{c}(n) = \operatorname{ar)} \min_{g,c(n)} \|d(n) - gc(n)*h(n)\| \tag{8}$$

where the search is performed over all entries of the gain table and the excitation codebook. As for the pitch loop, the search for g, c(n) can by simplified by first searching for the best excitation with an unconstrained (unquantized) gain and, then, quantizing that gain. In this case we have $$\hat{c}(n) = \underset{c(n)}{\operatorname{armax}} \frac{\langle d(n), c(n)*h(n)\rangle^2}{\|c(n)*h(n)\|^2} \tag{9}$$

$$g = \frac{\langle d(n), c(n)*h(n)\rangle^2}{\|c(n)*h(n)\|^2} \tag{10}$$

and g* is quantized to its nearest neighbor in the gain table.

The system described above is a basic version of a CELP coder. Numerous other versions of the same system have been proposed in the literature with various techniques for reducing the computational complexity, sometimes, at the price of reduced coding quality. Most of these techniques can be incorporated in the present invention as well.

Constrained Stochastic Excitation—Improved CELP

The Constrained Stochastic Excitation Code (CSEC) system of the present invention departs from the standard CELP described above at the stage of selecting g and c(n). In the CSEC system, these parameters are selected in such a way as to constrain the level of the excitation and make it adaptive to the performance of the long-term subsystem. The concept behind this approach is discussed next.

The CELP coding approach is based on a fundamental assumption that the residual signal, resulting from the inverse filtering operation $X(z)\,A'(z)(1-\beta z^{-P})$, is truly random and whatever residual information it has about the underlying source signal is not crucial for resynthesizing a good estimate for X(z). In other words, the residual signal can be replaced by another signal with similar statistical properties (but otherwise totally different) in the synthesis process. This assumption is based on the observation that the residual is essentially white and can be characterized as a Gaussian process.

In accordance with the present invention, we mitigate the penalty paid for our ignorance by placing some constraints on the "dumb" excitation. The idea is to reduce the harsh effect of introducing noise-like foreign signals which are totally unrelated to the speech signal.

Any excitation signal contains "good" and "bad" components in it. The good component contributes towards more acceptable output while the bad one adds noise to the system. Since, as said above, we cannot separate the two components we adopt the pessimistic philosophy that the entire excitation signal is "bad", that is, it is dominated by the undesired noisy component and the use of such an excitation should be restricted.

The two components of y(n) in Eq. (4) which carry new information about the source are the "pitch" signal $p(n)=\beta r'*h(n)$ and the filtered excitation $e(n)=gc(n)*h(n)$. p(n) is the result of attempting to utilize the periodicity of the source. There is no additive noisy component in it and the new information is introduced by modifying the delay P and the scale factor β. It is therefore expected to be perceptually more appealing than the excitation noisy component e(n). Fortunately, in voiced (periodic) regions, p(n) is the dominant component and this is an important reason for the success of the CELP method.

In R. C. Rose et at, "The Self-Excited Vocoder-an Alternate Approach to Toll Quality at 4800 bps," *Proc IEEE ICASSP*-86, pp. 453–456 (1986) it was suggested that the stochastic excitation be eliminated completely. Self-Excited Vocoder (SEV), the past portion of r(n) was the only signal used in exciting the LPC synthesis filter (that is, g=0). However, that coder was found to perform poorly especially in transition regions since, after initialization, no innovation excitation was used to account for new information. Realizing that problem, the developers of the SEV added two other components to the "self-excitation": regular stochastic excitation as in basic CELP and impulse excitation as in multi-pulse LPC coding. The "pure" SEV has actually never been used. Each of the three excitation components was optimized by the standard MSE procedure as outlined above without trying to perceptually enhance the overall excitation.

In accordance with the present invention, the noisy excitation is further reduced and a heavier reconstruction burden is imposed on the pitch signal p(n). However, since p(n) is not always efficient in reconstructing the output, particularly in unvoiced and transitional regions, the amount of excitation reduction should depend on the efficiency of p(n). The efficiency of p(n) should reflect its closeness to x(n) and may be defined in various ways. A useful measure of this efficiency is $$S_p = \frac{\|x(n)\|}{\|x(n) - y_0(n) - p(n)\|} \tag{11}$$

The quantity $S_p$ is used in controlling the level of the excitation. Recalling that the excitation is perceived as essentially a noisy component, we define the signal-to-noisy-excitation ratio $$S_e = \frac{\|x(n)\|}{\|e(n)\|} \tag{12}$$

The basic requirement now is that $S_e$ be higher than some monotone-nondecreasing thresholds function $T(S_p)$:

$$S_e \geqq T(S_p) \tag{13}$$

Figure 4A:
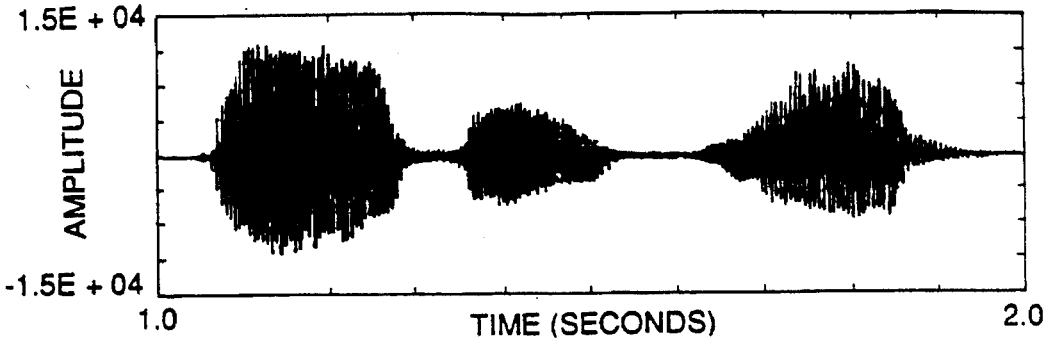
FIG. 4 shows how an important measure of efficiency of coding by a pitch-loop sub-system varies for a typical input.
Figure 4B:
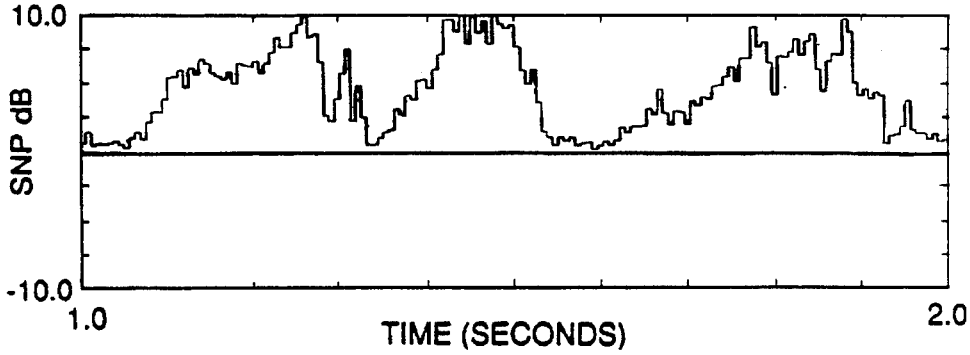

A useful empirical function $T(S_p)$ used by way of illustration in the present discussion is shown in FIG. 3. It consists of a linear slope (in a dB scale) followed by a flat region. When $S_p$ is high, i.e., when p(n) is capable of efficiently reconstructing the output, $S_e$ is forced to be high and e(n) contributes very little to the output. As $S_p$ goes down, the constraint on e(n) is relaxed and it gradually takes over, since p(n) becomes inefficient. $T(S_p)$ is controlled by a slope factor $\alpha$ and a saturation level f which determine the knee point of the function. Intuitively, the abscissa of the knee should lie around the middle of the dynamic range of $S_p$. FIG. 4 shows a typical time evolution of $S_p$ which indicates a dynamic range of about 1.0 to 10.0 dB. When $S_p$ is high, $S_e$ is forced to be higher than 24 dB with the intent that such an SNR will make the noisy excitation inaudible. Based on some listening to coded speech, illustrative values for these parameters are $\alpha$=6.0 and f=24.0 dB.

The procedure for constraining the excitation, whose details are discussed next, is quite simple: the system calculates $S_p$ for the current frame, determines the threshold using T(.) and selects the best excitation $\hat{c}(n)$ and the best gain $\hat{g}$ subject to the constraint of Eq. (13).

The objective is to find the best gain and excitation vector from the corresponding codebooks, under the constraint of Eq. (13). It proves convenient to seek to minimize the MSE under the above constraint.

Defining the unscaled excitation response $c_h(n)=c(n)*h(n)$, the minimization problem is, therefore, stated (Eq. (8)) as:

$$\hat{g},\hat{c}(n) = \underset{g,c(n)}{ar\ min}\ \{-2<d(n), c_h(n)> + g^2\|c_h(n)\|^2\} \tag{14}$$

subject to:

$$|\hat{g}|\|c_h(n)\| \leqq \frac{\|x(n)\|}{T(S_p)} \tag{15}$$

where the minimization range is the set of all the entries of the gain and excitation codebooks. It is clear from the quadratic form of the problem that for a fixed excitation c(n) the best gain is obtained quantizing the optimal gain as in (10), namely, $$g^* = \frac{<d(n), c_h(n)>}{\|c_h(n)\|^2} \tag{16}$$

Thus, for a given c(n) the best gain is:

$$\hat{g} = \underset{g}{armin}\ \|g - g^*\| \tag{17}$$

subject to Eq. (15).

The search procedure is to obtain the best gain for each excitation vector as in (17), record the resulting distortion and to select the pair $\hat{g}$, $\hat{c}(n)$ corresponding to the lowest distortion.

Figure 5:
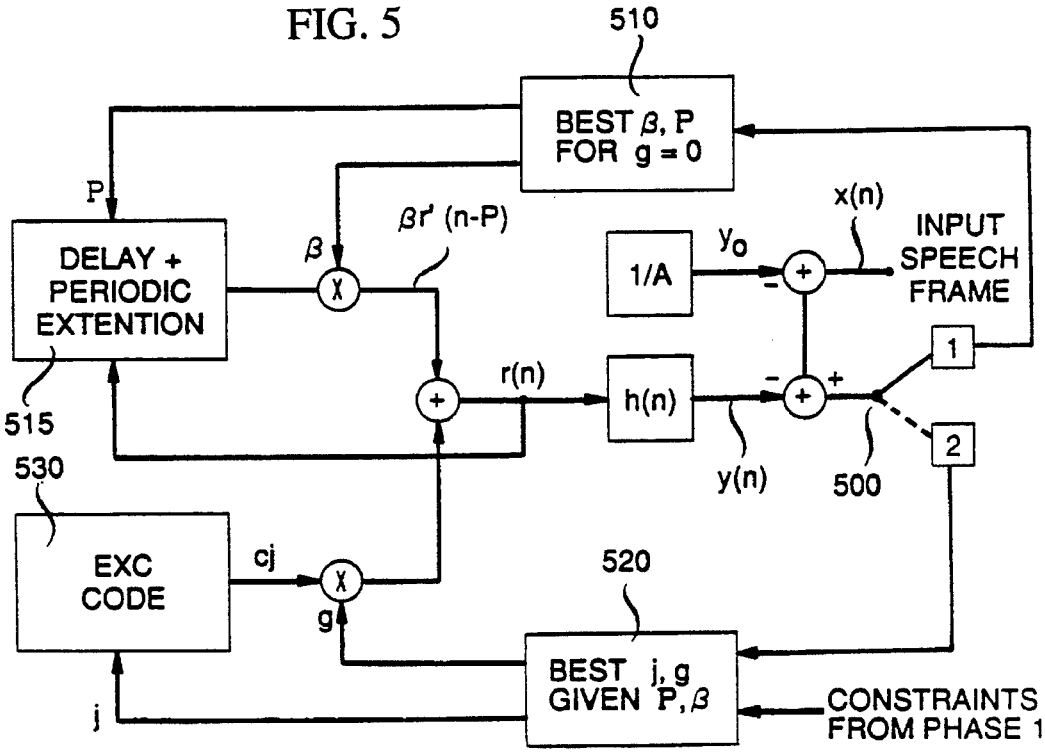
FIG. 5 is a summary representation of elements of the present invention.

FIG. 5 summarizes, in schematic form, several important aspects of the processing in accordance with the illustrative speech encoding process described above. The switch 500 has two positions, corresponding to the two phases of processing.

The first position, 1, of switch 500 corresponds to that for the determination, in block 510, of the values for the pitch parameter(s) $\beta$ and P. For this determination, a value of g=0 is assumed, i.e., the excitation signal is assumed to have zero amplitude. Thus a measure is taken of how well the pitch loop is able to represent the input signal. That is, the contributions of $y_0$ (the "zero memory hangover" or initial state response of the filter 1/A) and $\beta r'(n-P)$ when convolved with h(n) are used to evaluate a y(n), as in equation (4), with a value of g=0.

In phase 2 of the processing, with switch 500 in position 2, the best values for j and g are determined in block 520, given the constraints derived from phase 1 of the processing. Here, the excitation codes from store 530 are used as well as the phase 1 operands.

The subjective performance of the CSEC coder was measured by the so-called A–B comparison listening test. In this subjective test a set of speech segments is processed by coder A and coder B. The two versions of each sentence are played and the listener votes for the coder that sounds better according to his/her judgement. Results of these tests show a clear overall improvement as compared with the basic CELP coding known in the art.

The complexity of the CSEC coder is essentially the same as that of the CELP since the same type and amount codebook-search arithmetic is needed in both coders. Also, most of the complexity-reducing "tricks" that have been proposed for the CELP algorithm can be combined with the CSEC method. Therefore, the CSEC method is essentially a no-cost improvement of the CELP algorithm.

No changes are needed in the CELP decoder other than the requirement that the excitation gain be responsive to the coded gain parameter supplied by the coder.

The above description of the present invention has largely been in terms of departures from standard CELP coders of well-known design. Accordingly, no additional structure is required beyond those minor hardware design choices and the program implementations of the improved algorithms of the present invention. Likewise, no particular programming language or processor has been indicated. Those skilled in the an of coding of speech and related signals will be familiar with a variety of processors and languages useful in implementing the present invention in accordance with the teachings of this specification.

While the above description of the present invention has been in terms of coding of speech, those skilled in the art of digital signal processing will recognize applicability of these teachings to other specific contexts. Thus, for example, coding of images and other forms of information may be improved by using the present invention.

I claim:

1. In a communication system, a method for encoding an input signal to form a set of output signals, said method comprising the steps of:

transducing an acoustic signal to generate said input signal;

generating one or more predictor parameter signals, including one or more long term predictor parameter signals, for said input signal;

generating a plurality of candidate signals, each of said candidate signals being synthesized by filtering a coded excitation signal in a filter characterized by said predictor parameter signals, each of said coded excitation signals having an associated index signal, and each of said coded excitation signals being amplitude adjusted in accordance with the value of a gain control signal prior to said filtering;

comparing each of said candidate signals with said input signal to determine a degree of similarity therebetween;

jointly selecting a coded excitation signal and a value for said gain signal such that said degree of similarity is maximized, subject to the constraint that said value for said gain signal be chosen such that a predefined first function of the level of the input signal relative to the candidate signal exceeds a predefined threshold function;

for each of said input signals, selecting said predictor parameter signals, said index signal corresponding to said selected coded excitation signal and said selected value for said gain signal as said set of output signals which represent said input signal.

2. The method of claim 1 comprising the further step of sending one or more of said predictor parameter signals, said index signal corresponding to said selected coded excitation signal and said selected value for said gain signal to a decoder.

3. The method of claim 1, wherein said step of generating a plurality of candidate signals comprises storing a codeword corresponding to each of said coded excitation signals, and sequentially retrieving said codewords for application to said filter.

4. The method of claim 1, wherein said selecting comprises constraining said value for said gain signal to a range including zero.

5. The method of claim 1, wherein said selecting comprises setting said value for said gain signal substantially to zero when the output of said filter characterized by said one or more long term predictor parameters approximates said input signal according to said predetermined first function.

6. The method of claim 1, wherein said one or more long term predictor parameter signals are pitch predictor parameter signals.

7. The method of claim 1, wherein said input signals are perceptually weighted speech signals having values x(n), n=1,2, . . . ,N, wherein said candidate signals each comprise values e(n), n=1,2, . . . ,N and said predetermined first function is given by $$S_e = \frac{\|x(n)\|}{\|e(n)\|},$$

and said threshold function is given by $$S_e \geqq T(S_p),$$

where $T(S_p)$ is a monotonic nondecreasing function of a measure, $S_p$, of how closely the output of said filter, when characterized only by said one or more long term predictor parameters and without the application of said coded excitation signals, approximates x(n).

8. The method of claim 7 wherein said predictor parameters characterize a linear predictive filter and wherein $S_p$ is a measure of the signal-to-noise ratio given by $$S_p = \frac{\|x(n)\|}{\|x(n) - y_0(n) - p(n)\|}$$

with $y_o(n)$ being the initial response to the filter with no excitation and p(n) being the output of the filter characterized by said long term parameter with no input.

* * * * *